United States Patent [19]

Maschhoff

[11] 4,433,520

[45] Feb. 28, 1984

[54] BUILDING WALL CONSTRUCTION

[76] Inventor: Jack Maschhoff, 328 W. Harrison, Royal Oak, Mich. 48067

[21] Appl. No.: 216,527

[22] Filed: Dec. 15, 1980

[51] Int. Cl.[3] ..... E04B 2/32

[52] U.S. Cl. ..... 52/275; 52/426; 52/564

[58] Field of Search ..... 52/564, 380, 385, 426, 52/275, 276, 277, 278, 279, 562, 563, 565

[56] References Cited

U.S. PATENT DOCUMENTS

| | | | |
|---|---|---|---|
| 270,464 | 1/1883 | Ormsby | 52/282 |
| 1,325,079 | 12/1919 | Coggan | 52/275 |
| 1,453,557 | 5/1923 | Wagner | 52/426 |
| 1,682,414 | 8/1928 | Polacoff | 52/595 |
| 1,962,514 | 6/1934 | MacWilliam | 52/564 |
| 3,562,991 | 2/1971 | Kustusch | 52/564 |
| 3,759,002 | 9/1973 | Cornella et al. | 52/595 |

FOREIGN PATENT DOCUMENTS

| | | | |
|---|---|---|---|
| 328337 | 3/1958 | Switzerland | 52/565 |
| 174792 | 2/1922 | United Kingdom | 52/360 |

*Primary Examiner*—John E. Murtagh
*Assistant Examiner*—Richard E. Chilcot, Jr.
*Attorney, Agent, or Firm*—Barnes, Kisselle, Raisch, Choate, Whittemore & Hulbert

[57] ABSTRACT

Interfitting structural modules are built up in overlapping courses or tiers on a horizontal foundation into the desired building wall formation and either used as such or as a form assembly into which concrete may be poured. Each module includes a pair of laterally spaced elongated parallel vertical panels interconnected at their tops and ends by wire grating spacers. Corner constructions are provided which may be utilized for right angle corners or corners with obtuse angles, there being a suitable joint provided for the intersecting inside and outside panels together with special corner wire grids for stabilizing the related parts of the corner constructions.

9 Claims, 13 Drawing Figures

BUILDING WALL CONSTRUCTION

FIELD OF INVENTION

Interfitting structural modules to form residential and commercial buildings when arranged in longitudinal and tiered relation on a horizontal foundation.

BACKGROUND OF INVENTION

In a U.S. patent to Kustusch, U.S. Pat. No. 3,562,991, issued Feb. 16, 1971, there is disclosed a self-supporting building structure module for a building wall with front and rear panels horizontally spaced and rigid spacer means therebetween in the form of wire grating.

The present invention is directed to an improved construction which facilites the use of the modules at corners, whether right angled corners, or corners having angles greater than 90° and thus useful for round structures. A further object is the provision of a grating construction to rigidify the corner constructions and facilitate the interlock of the modules and the interfitting ends and the horizontal joints of the tiered modules.

Other objects and features of the invention will be apparent in the following description and claims in which the invention is described together with details of the manner and process of using the invention directed to persons skilled in the art, all in connection with the best mode presently contemplated for the practice of the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

It is assured that a proper foundation is provided with a horizontal surface having a lateral width to receive the completed modules. Basically, the modules consist of inner and outer preformed panels formed of plywood or other suitable materials such as structural particle board, fiber concrete. The panels are spaced laterally from each other by wire rod grids as described in detail in the referenced U.S. Pat. No. 3,562,991.

Figure 1:
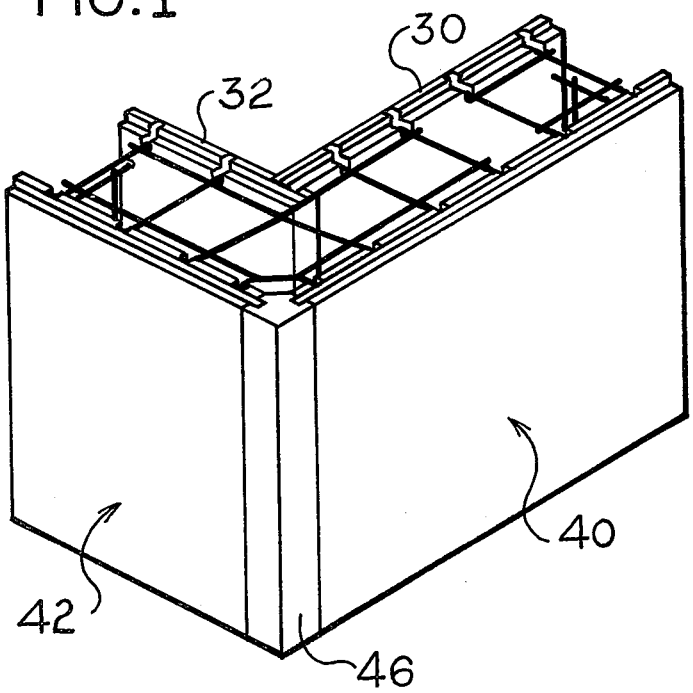
FIG. 1, a perspective view of a completed right angle corner construction.
Figure 8:
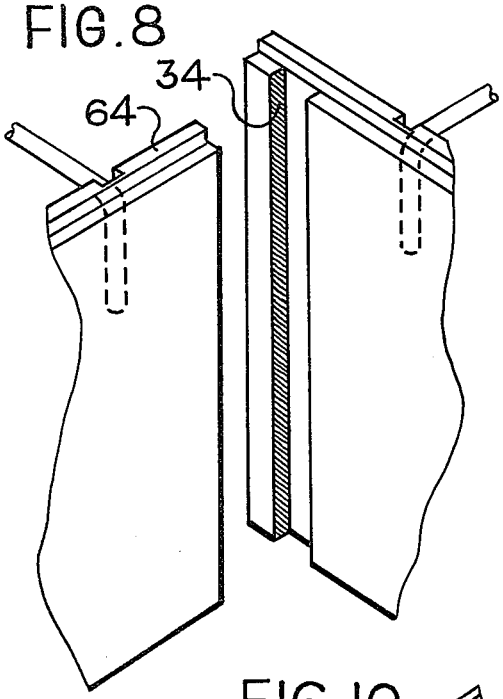
FIG. 8, a view of a vertical corner interlock of inside panels.
Figure 11:
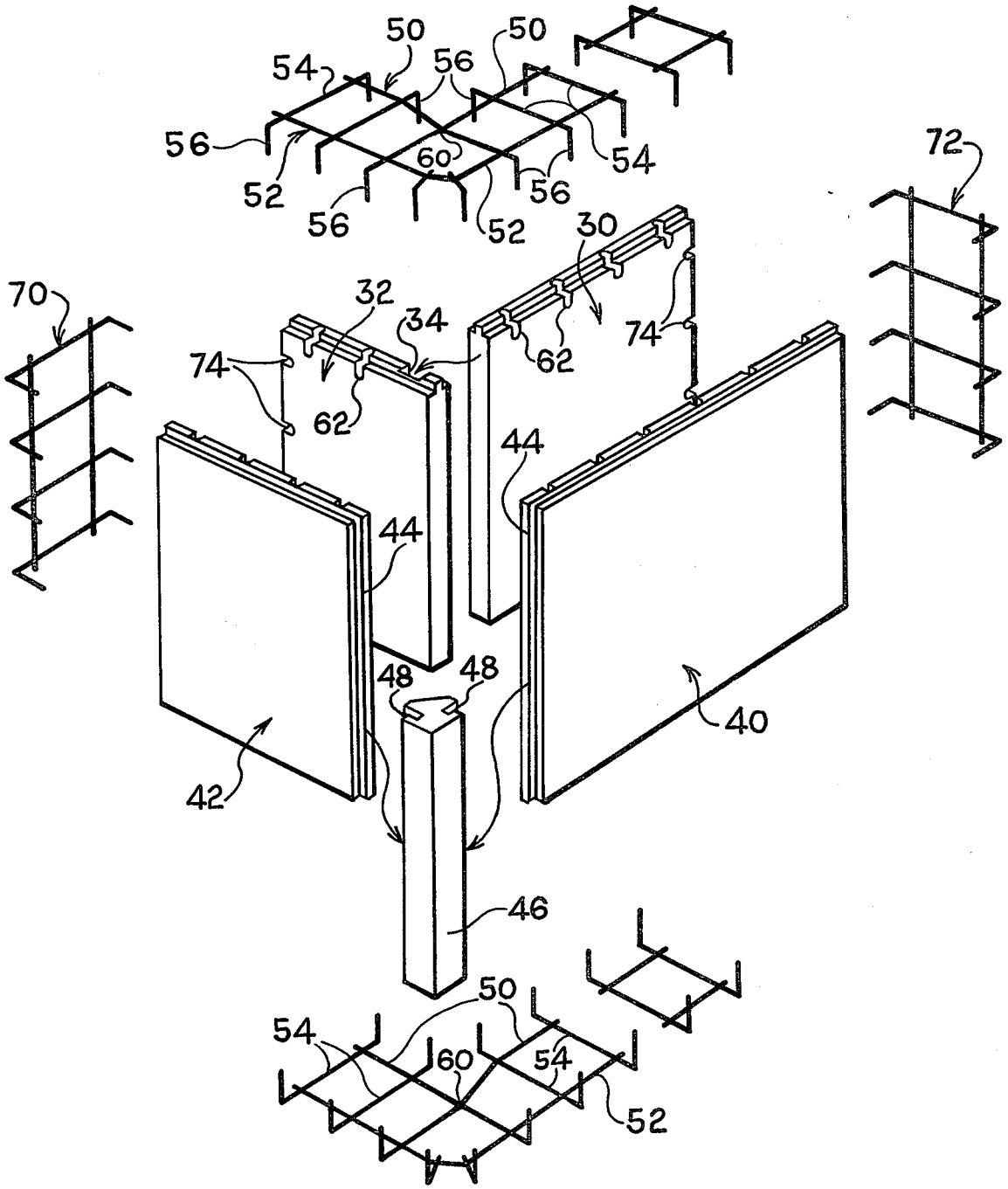
FIG. 11, an exploded view of the parts in a right angle joint.

In the present invention, as illustrated first in FIG. 1, the inside right hand panel 30 is interfitted at a right angle joint with an inside left hand panel 32. The vertical interfitting joint is shown in FIGS. 3, 8 and 11 wherein one end of an inside panel fits into a groove 34 in the other inside panel.

Figure 9:
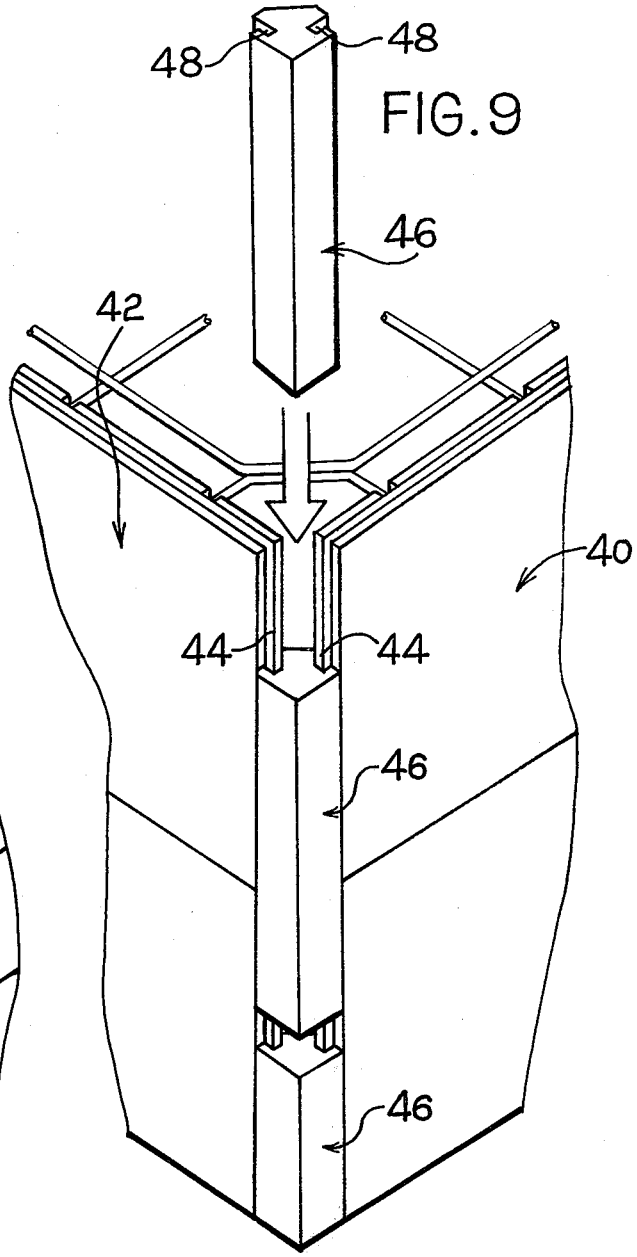
FIG. 9, a view of a vertical joint of outside panels.

The outside panels 40 and 42 are disposed at right angles to each other in spaced relation, each having a tongue 44 facing the corner. A corner post 46 is provided with grooves 48 to receive the tongues 44 (FIG. 9).

Figure 3:
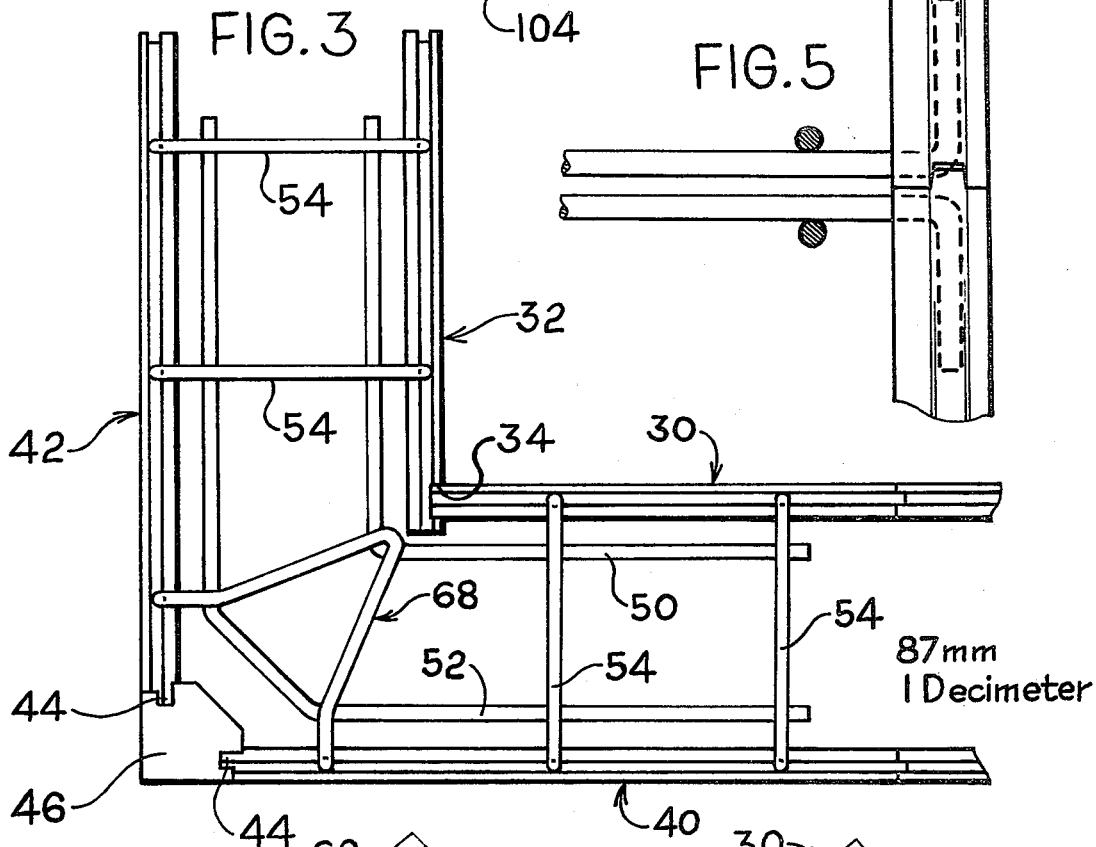
FIG. 3, a top view of a right angle corner.
Figure 5:
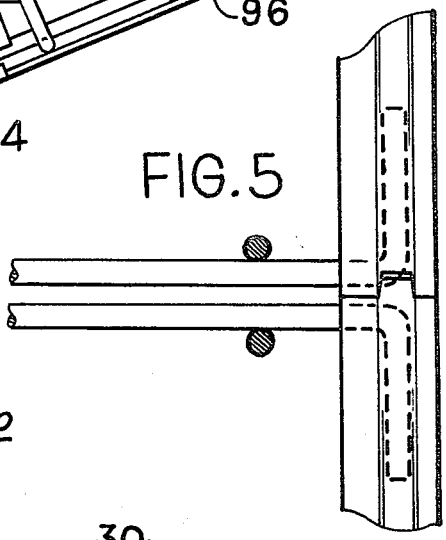
FIG. 5, a partial view showing a tongue and groove interlock in a horizontal joint.
Figure 6:
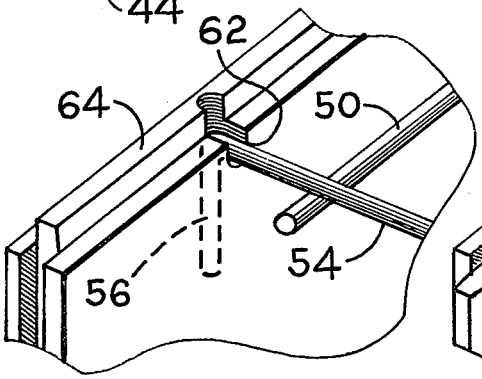
FIG. 6, a perspective view of an outside panel and tongue.
Figure 7:
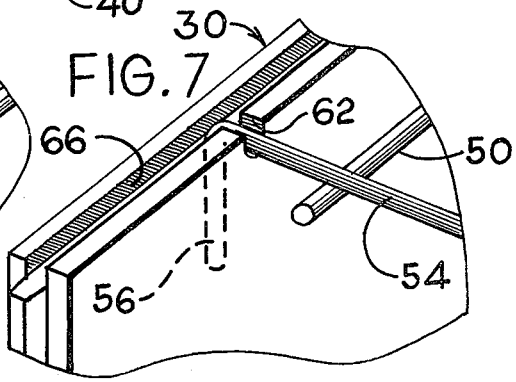
FIG. 7, a perspective view of an outside panel and groove.

A rigid corner grid is provided to perform the spacer function at the corner as shown in FIG. 3 where a web of spaced rods 50 and 52 are connected by lateral rods 54 each with downturned ends 56. The inner rods 50 are welded to the cross corner rod 60 as best shown in FIG. 11. As best shown in FIGS. 6 and 7, laterals 54 of the grid are received in notches 62 in order that they will not interfere with the horizontal tongue 64 and groove 66 joint between vertically adjacent tiered panels.

As shown in FIG. 3, a V-shaped or triangular reinforcement 68 can provide the lateral spacing directly at the corner.

As illustrated in FIG. 11, the corner element has grids 50 on top and bottom and rectangular grids 70 and 72 at the ends. The laterals of the end grids are also recessed in notches 74 to clear the vertical tongue and groove joints between adjacent panels.

Figure 10:
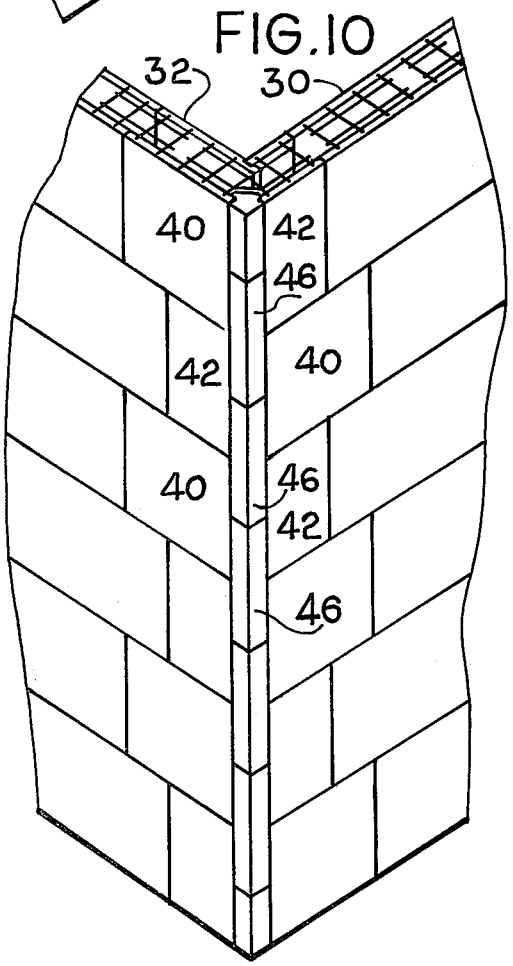
FIG. 10, a perspective view of a completed tiered corner.

As shown in FIGS. 1 and 10, the corners have a short section 42 and a long section 40 so that they will overlap in vertical tiering. Similarly, the corner posts 46 span the horizontal joints to provide additional stability (FIGS. 9 and 10).

Figure 2:
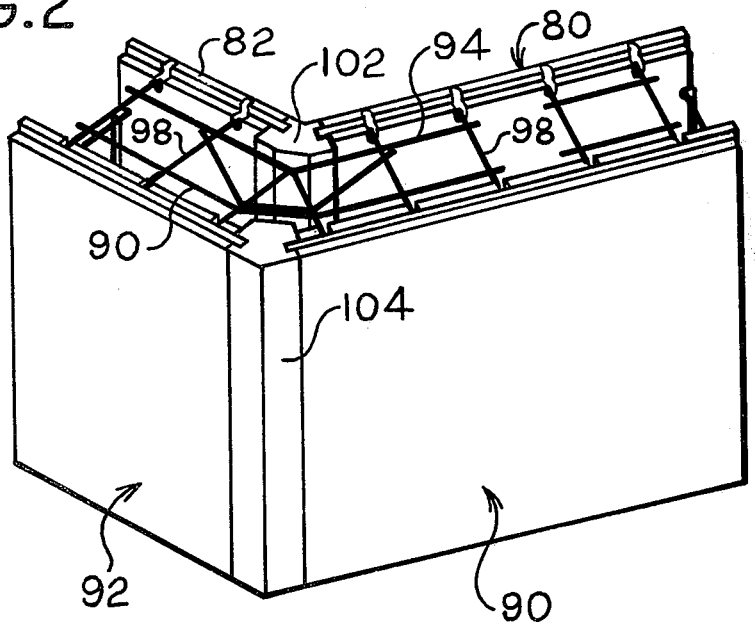
FIG. 2, a perspective view of a completed corner having an obtuse angle.
Figure 4:
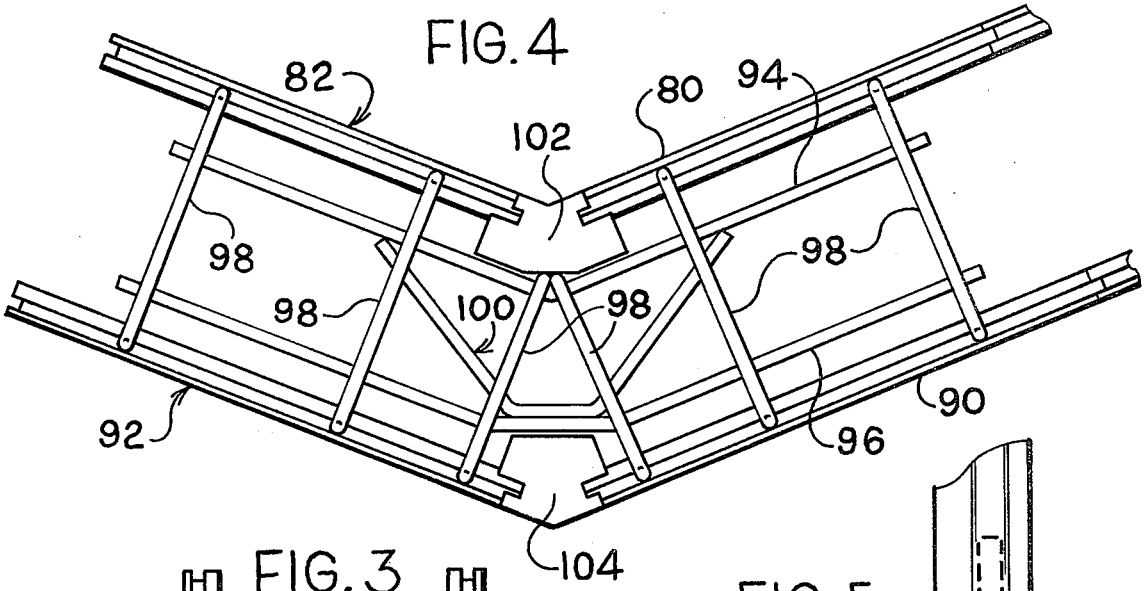
FIG. 4, a top view of an obtuse angle corner.
Figure 12:
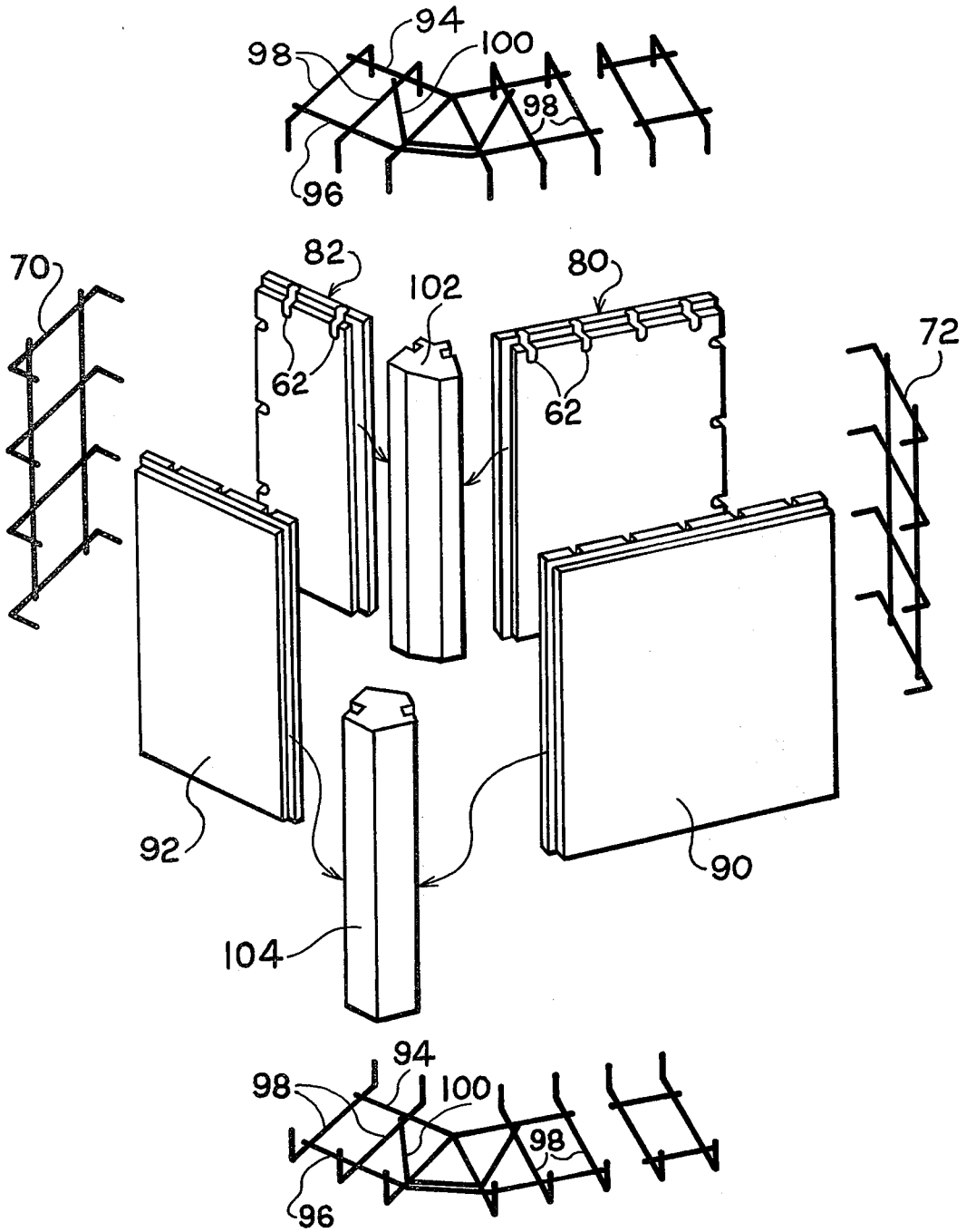
FIG. 12, an exploded view of the parts in an obtuse angle joint.

In FIGS. 2, 4 and 12, an obtuse angle corner construction is shown. Inner panels 80 and 82 are spaced from outer panels 90 and 92 by grid structures which have inner and outer rods 94 and 96 and laterals 98. A suitable open V unit 100 can also be used. Both the inside and outside panels are joined in tongue and groove joints with corner posts 102 and 104 respectively.

Figure 13:
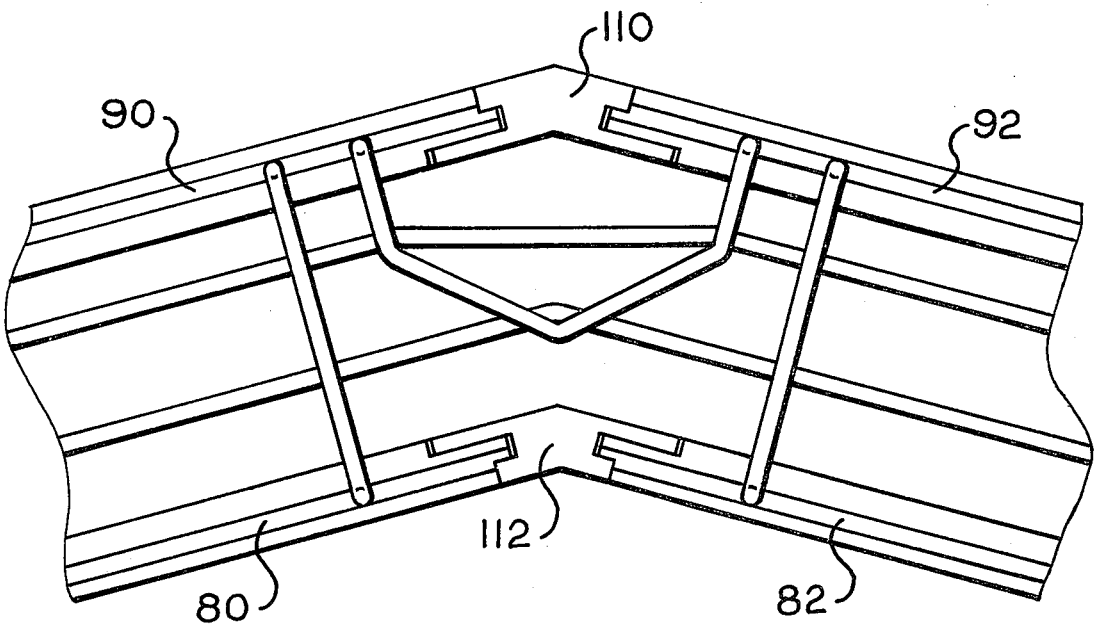
FIG. 13, a modified corner using elements generally within the confines of the panel thickness.

In FIG. 13, a modification is shown wherein wood corners 110 and 112 are formed to provide the re-entry grooves to receive the wall panels. When used as a form, the structure is such that it will leave no grooves in the cast material. As shown in FIG. 13, the corner posts 110 and 112 have lateral wings extending beyond the basic lateral dimension of the post.

Thus, it will be seen that the corner units can be made up in advance just as the straight modules are made up and the modules may be assembled quickly in horizontal and tiered relationship with tight tongue and groove joints at each horizontal and vertical seam, the grids being positioned to allow free assembly of the joints. The space between the panels can remain open or be filled with sand, foamed aggregate or concrete. At each corner joint and at vertical joints the panels are overlapped horizontally to give added strength.

The spacing of the recess holes in the structure illustrated in U.S. Pat. No. 3,562,991 was preferred at 2", 5", 2", 5", etc. The spacing preferred in the present structure is 10 centimeters or 1 dm, starting at 5 cm from each end. Tongue and groove joints are provided on the horizontal edges and the vertical joints. If the structure is to be used as a form and removed after casting a filler within, the corners are preferably formed so that they do not project into the interior. See, for example, the outside corner 46 of FIG. 1. See also FIG. 13, previously described, where corner structures are confined essentially to the wall thickness.

I claim:

1. A corner construction for a self-supporting building structure module for a building wall construction utilizing spaced outside and inside panels maintained in spaced relation by rigid spacer means spanning the space between the panels, said corner construction being assembled and retained in assembly without adhesives or cement and which comprises:

(a) one or more pairs of outside panels disposed with vertical edges in spaced relation and in planes at a predetermined corner angle and having tongue projections on the spaced edges, (b) one or more pairs of inside panels disposed in planes at the same predetermined corner angle as the outside panels, (c) one or more L-shaped substantially rigid spacer frames having legs disposed relative to each other at said corner angle and having portions to interfit with and tie together horizontal edges of said pairs of inside and outside panels to maintain said panels at said corner angle and in spaced relation, and (d) a first corner interlock post unconnected to an independent of said rigid spacer means having opposed grooves to receive respectively said tongues on said outside panels and dimensioned laterally to be driven endwise into the space between said spaced vertical edges of said outside panels to rigidify the corner module.

2. A corner module construction as defined in claim 1 in which said vertical edges of said inside panels are engaged in a mechanical interlock.

3. A corner module construction as defined in claim 1 in which said inside pair of panels have vertical edges in spaced relation and having tongues projecting on the spaced edges, and a second corner interlock post having opposed grooves to receive the tongues of the spaced edges of said inside panels also dimensioned to be driven endwise into the space between said vertical edges of said inside panels to interlock said inside panels and rigidify the corner module.

4. A corner construction as defined in claim 1 in which a plurality of pairs of inside and outside panels are stacked vertically with horizontal joins and said corner interlock post is dimensioned and positioned longitudinally to bridge the horizontal joins of said panels.

5. A corner construction as defined in claim 1 in which said spacer means comprises inner and outer runs of rod-like material rigidly joined together by transverse cross rods and reinforcing members extending across the legs of the spacer means at the corner to form a triangular reinforcement.

6. A corner construction as defined in claim 1 in which the corner interlock post has opposed grooves disposed at angles to receive the tongues of panels with spaced vertical edges, a corner surface on the outside of said post and a relatively flat surface on the inside of said post.

7. A corner construction as defined in claim 1 in which the inside of said post has lateral wings extending beyond the basic lateral post dimension.

8. A corner construction for a self-supporting building structure module for a building wall construction utilizing spaced outside and inside panels maintained in spaced relation by rigid spacer means spanning the space between the panels, said corner construction being assembled and retained in assembly without adhesives or cement and which comprises:

(a) two or more pairs of outside panels disposed with horizontal edges in a common plane and with vertical edges in spaced relation and in vertical planes at a predetermined corner angle and having tongue projections on the spaced vertical edges, (b) two or more pairs of inside panels parallel to the outside panels and disposed in planes at the same predetermined corner angle as the outside panels, (c) two or more L-shaped substantially rigid spacer frames lying in a horizontal plane and having legs disposed relative to each other at said corner angle and extending between said pairs of inside and outside panels, the inside and outside edges of said frame having portions to interfit with and tie together horizontal edges of said inside and outside panels to maintain said panels at said corner angle and in spaced relation, and (d) first corner vertical interlock posts unconnected to and independent of said rigid spacer means having opposed grooves to receive, respectively, said tongues on said outside panels and dimensioned laterally to be driven into the space between said spaced vertical edges of said outside panels and dimensioned longitudinally to extend a relative distance into said space between vertically adjacent pairs of panels to lock the pairs of panels against lateral displacement.

9. A corner construction as defined in claim 8 in which the panels of each corner pair have different horizontal dimensions to comprise long and short panels in each pair and said panels are arranged to place on each side of a corner alternate long and short panels tiered vertically.

* * * * *